US005085767A

United States Patent [19]

Beers

[11] Patent Number: 5,085,767

[45] Date of Patent: Feb. 4, 1992

[54] SWIMMING POOL SKIMMING APPARATUS

[76] Inventor: John A. Beers, 18605 McCoy Ave., Port Charlotte, Fla. 33945

[21] Appl. No.: 625,979

[22] Filed: Dec. 11, 1990

Related U.S. Application Data

[63] Continuation-in-part of Ser. No. 519,930, May 7, 1990, abandoned.

[51] Int. Cl.[5] ..... E04H 4/16

[52] U.S. Cl. ..... 210/169; 4/490; 210/238; 210/242.1

[58] Field of Search ..... 4/490, 496; 210/776, 210/169, 238, 242.1, 242.3, 488, 470, 490

[56] References Cited

U.S. PATENT DOCUMENTS

| | | | |
|---|---|---|---|
| 2,367,997 | 1/1945 | Chambers | 4/490 |
| 3,585,654 | 6/1971 | Jacobs | 4/490 |
| 4,053,412 | 10/1977 | Stix | 210/169 |
| 4,089,074 | 5/1978 | Sermons | 210/169 |
| 4,472,842 | 9/1984 | Jarrett | 210/169 |
| 4,557,001 | 12/1985 | Burkhart | 210/169 |
| 4,879,028 | 11/1989 | Gibson | 210/169 |
| 4,972,529 | 11/1990 | Wolfson | 4/496 |

FOREIGN PATENT DOCUMENTS

| | | | |
|---|---|---|---|
| 3414905 | 10/1985 | Fed. Rep. of Germany | 210/242.1 |
| 45-32194 | 10/1970 | Japan | 210/924 |

*Primary Examiner*—Peter Hruskoci
*Attorney, Agent, or Firm*—Frank A. Lukasik

[57] ABSTRACT

The present invention is directed toward the removal of all surface debris from the water surface of swimming pools comprising, a buoyant tube, arrayed along its entire length with a fibrous absorbent material affixed at each of the extreme ends of said tube. The entire central portion of the material between the extreme ends is permitted to hang loose and unfettered. The skimming apparatus is swept along the pool and then wound one end inside the other until the inner circle has been reduced to a diameter of two or three feet thereby concentrating the density of the debris which then can be easily removed.

7 Claims, 2 Drawing Sheets

SWIMMING POOL SKIMMING APPARATUS

RELATED PATENT APPLICATION

This is a continuation-in-part of patent application Ser. No. 07/519,930, filed May 7, 1990, now abandoned, the disclosures of which are incorporated by reference.

BACKGROUND OF THE INVENTION

1. Field of the invention

This invention relates generally to swimming pool cleaning apparatus and more particularly to an improved means for cleaning the water surface of swimming pools by providing an apparatus for skimming the surface of the water to remove all floating substances.

2. Discussion of the prior art

There are numerous devices available for skimming water surfaces. The automatic skimming provided by a pool's circulation system through the surface drain is very slow and may take hours to process, to the best of its ability, the surface water that does pass through it. While the surface drain is being used for skimming, use of an automatic vacuum device is precluded. In addition, this type of skimming has been found to be ineffective against the lighter, more buoyant, detridus commonly found floating on the surface of swimming pools, whether screened, unscreened, or indoor, (e.g., gnats, mites, spiders, dust, pollen, body or sun tan oil film, hair, insect spoor, pollution fallout, etc.). The finer elements of this detridus, the dust, the pollen etc., can actually float on top of the film of oil and combine with it to form a scum of a greater or lesser degree so buoyant that it could only be skimmed with a surface skimmer capable of sucking air as well as water—a process which is normally detrimental to all known pool pumps.

Hand held skimming devices which usually involve some form of screening mounted on a hoop attachable to a pole are also inefficient and ineffective against the smaller but omnipresent types of debris outlined above. Leaves, larger bugs and debris visible to an observer six to eight or more feet away may be strained out, but the smaller matter-the gnats, smaller bugs, the insect spoor, the dust, the oils and surface scum will pass right through the sieve and will soon reform on the surface where their presence will be distastefully obvious to the bather with his closer perspective. The bather need only stand still and look around carefully to find himself surrounded by all manner of unpleasant matter not readily visible on an agitated water surface or in all light. It is this inability of all known swimming pool skimming devices to cope with this fine debris and surface scum in an efficient and effective manner that a need was manifest for an apparatus that improved upon all known existing devices and methods in an expedient, effective and inexpensive manner.

There are several prior art patents in the field of skimming water surfaces which include: U.S. Pat. Nos.: 4,472,842; 4,557,001; 4,006,082; 4,053,412; 4,089,074; and 4,356,088. Except for U.S. Pat. No. 4,557,001, for the most part, the above referenced patents are related to the process of skimming or corralling and separating oil floating on the surface of water by using a boom or floating barrier which are imperforate, and are not designed for or are suitable for skimming the fine debris from the water surface of swimming pools. U.S. Pat. No. 4,557,001 appears to be more suitable for use in removing debris from the water surface of an unscreened backyard pool and would no doubt be effective in dealing with the larger type debris, (leaves, grass, flies, beetles, etc.) that may be found on the water surface thereof, but the smaller particles and scum would pass on through the rigid barrier presented by the weighted nylon or acetate mesh skirt as it was being pulled along the pool's surface or slide back into the water as the device was being removed. It is in the effective removal of the minute, but elusive finer type of debris that a need exists, and towards which this present invention is particularly and effectively directed. U.S. Pat. No. 4,472,842 uses a skein of material suspended from a series of connected floats and has a purpose similar to the present invention, but a radically different, less efficient, and less effective means of dealing with the problem.

SUMMARY OF THE INVENTION

The present invention is directed to the removal of all surface debris from the water surface of swimming pools in general, and to the skimming, corralling and removing the finer debris oils and scum normally missed by existing means and methods.

Accordingly, it is a principal object of the present invention to provide a new and improved swimming pool skimming apparatus.

It is another object of the invention to provide a rugged, swimming pool skimming apparatus which is inexpensive to manufacture, easy to assemble, and accomplishes its objectives in a speedy, efficient and effective manner.

Another object of the invention is to provide a swimming pool skimming apparatus which is capable of removing large as well as minute floating objects.

These and other objects of the invention will become apparent to those skilled in the art to which the invention pertains when taken in light of the annexed drawings.

DESCRIPTION OF THE PREFERRED EMBODIMENT

Figure 7:
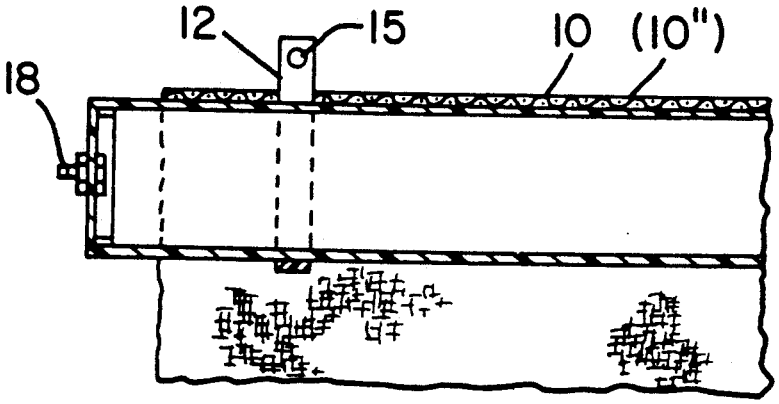
FIG. 7 is a side view, partially in section, of a second embodiment of the invention.
Figure 8:
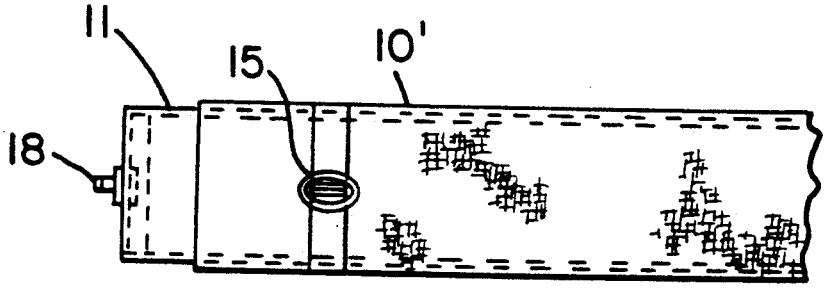
FIG. 8 is a top view of a second embodiment of the invention.
Figure 9:
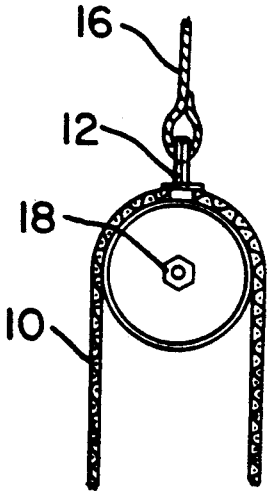
FIG. 9 is an end view of a second embodiment of the invention.

The present invention is directed toward the removal of all surface debris from the water surface of swimming pools in general. As shown in FIGS. 1 through 6, the apparatus consists of a sleeve of soft, loosely woven fibrous material 10, (such as cheesecloth), having a diameter of approximately eight inches, and of a suitable length for a particular size swimming pool. The fibrous material sleeve 10 is caused to envelop an elongated, slightly longer, buoyant tube 11, said tube being either constructed of buoyant material or rendered buoyant pneumatically. As shown in FIGS. 7 through 9, a length of vinyl or rubber 1 ½ inch diameter hose was sealed at each end, a valve 18, mounted at one end and the tube was inflated until it was sufficiently rigid and buoyant to support the fibrous material 10. Valve 18 may be a tire valve or a plastic valve of the type used for inflatable toys. After the tube 11 is slipped through the sleeve 10, the sleeve 10 is strapped, cinched or otherwise affixed at each of its extreme ends to the corresponding extreme ends of the buoyant tube 11 with straps 12 as shown in FIGS. 4, 5, 7, and 8.

Figure 1:
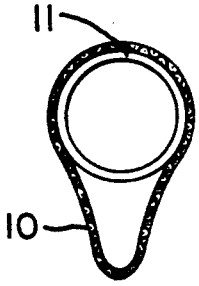
FIG. 1 is an end view, partially in section, of a swimming pool skimming apparatus of the present invention.
Figure 2:
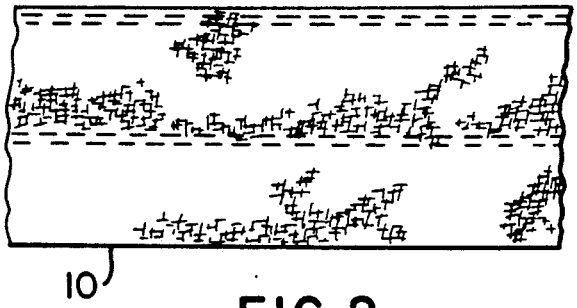
FIG. 2 is a side view of a section of a swimming pool skimming apparatus of the present invention.
Figure 3:
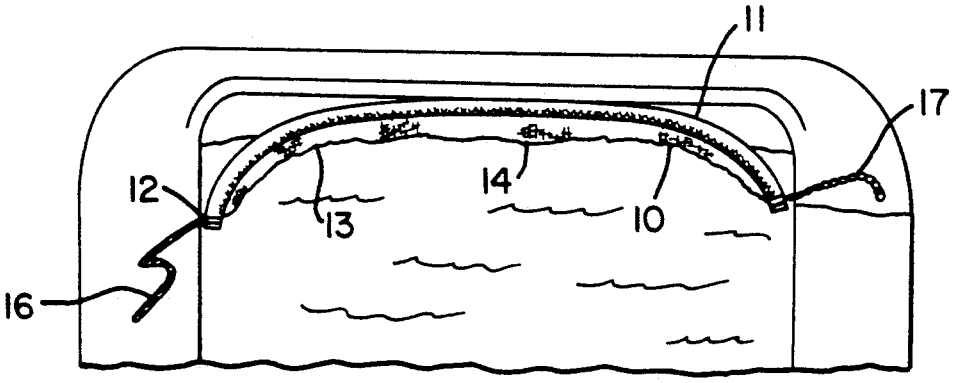
FIG. 3 is a perspective view of a swimming pool skimming apparatus of the present invention in operation in a swimming pool.
Figure 4:
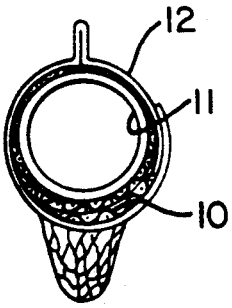
FIG. 4 is an end view showing the assembly of an end section of the present invention.
Figure 5:
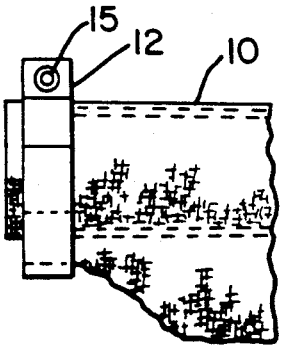
FIG. 5 is a side view showing the assembly of an end section of the present invention.

FIG. 3 shows the swimming pool skimming apparatus 13 in operation in a swimming pool. The entire central portion of the sleeve 10 between the extreme ends of apparatus 13 is permitted to hang loose and unfettered over the central portion of tube 11 as shown at numeral 14. The cord 16 of strap 12 used to affix the sleeve 10 endings to the buoyancy component tube 11 may be made sufficiently long to serve as a means for pulling its respective end along the pool side or it may contain a grommet hole 15 in which line 16 may be inserted. The strap 12 may be made of a plastic material and is shown in FIGS. 4 and 5 as being fastened by the gripping action of VELCRO. VELCRO, a registered Trademark of VELCRO USA Inc., 406 Brown Ave., Manchester, N.H. 03108, is a self-gripping fastening system which requires no screws, bolts or nails. VELCRO consists of a loop tape and a hook tape which when fastened together, holds tight against a direct pull and peels apart easily when desired. Other means, such as, for example a buckle or snap may be used for fastening the strap 12. When a sole person is operating the apparatus 13, it is suggested that a pool side weight 17 be affixed to one end in order to hold it in position temporarily while manipulating the opposite end. Although weight 17 is depicted as a chain, other weights such as, for example, a ½ gallon plastic milk jug filled with water, may be used.

Figure 10:
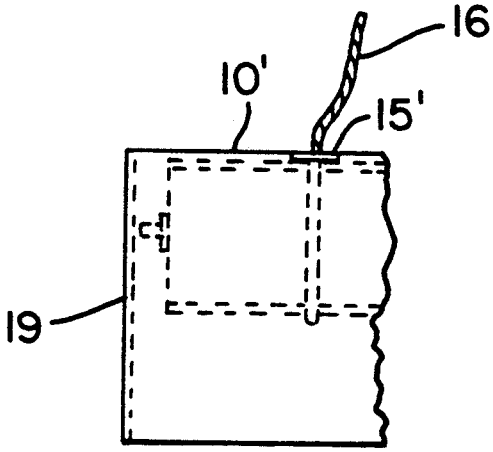
FIG. 10 is a side view of an alternative end closure of the invention.

FIGS. 7 through 10 depict a second embodiment of the invention. Instead of the loose sleeve 10 shown in FIG. 1, a length of absorbing fabric 10', similar to, but more durable than cheesecloth, having a width of approximately twelve to sixteen inches, is draped evenly over the entire length of the flotation tube 11 so that it hangs straight down about five or seven inches into the water from the leading and following edges of the tube 11. Eyelets 15' are provided at the fabric 10' upper axis, a few inches from each of its ends through which the straps 12 affixed to each end of the flotation tube 11 can be led. As shown in FIG. 10, the outer edges at each end of the fabric 10' may be joined by vertical seams 19, so as to form hoods that can be slipped over each end of the flotation tube 11, to hold the fabric 10' in position over the ends of the tube 11 and prevent the fabric strip endings from being knocked askew as they are being pulled along in contact with the pool walls. The entire tube 11, or a sufficient portion of its upper side, may be provided with a roughened surface to keep the fabric 10' from slipping about. Generally, drenching fabric 10' with water while it is being deployed makes the fabric 10' adhere to the flotation tube 11 to accomplish its purpose. Fabric 10' may also be made from two lengths of material, with an eyelet 15' at the end near the end of tube 11, and the fabric 10' sections slightly overlapping each other near the center of tube 11. In deploying these sections of fabric 10', the sections should be soaked so that they will cling to the tube 11, then the strap 12 at one end of the flotation tube is led through its corresponding eyelet 15' and then the wet fabric 10' is arrayed equally along the upper side of the tube 11, so that it extends slightly past the center of the tube 11. The second section is then similarly deployed from the opposite end of the tube 11 in such a way that it overlaps the first. If three or more segments are used, they should be arrayed in such a way that each central section is always overlapping (or being overlapped) by either its adjoining central section, or one or both side sections.

Another alternative construction for fabric 10' would be to use disposable material such as, for example, paper towels 10'' dispensed from a continuous roll. Assembly of the skimming apparatus 13 with paper would proceed as above but without placing the strap 12 through an eyelet 15'. Assembly of the skimming apparatus 13 with paper towels 10'' would proceed as described above for using a strip of absorbent fabric 10' (except that no hoods 19 are used), the roll of paper towels 10'' is oriented to 90° to, and equally straddling, the paper axis of the buoyant tube 11 starting at one end of the tube 11, the paper towels 10'' are unwound along the upper axis of said buoyant tube 11 towards the opposite end thereof, moistening said paper towels 10'' with a little water every few feet in the process until the entire tube 11 is covered with the moistened paper towels 10''. The paper towels 10'' would hang from the tube 11 just as described above for the absorbent fabric strips 10'. Holes for eyelets 15 may be forced through the end towels 10'' to permit the line 16 or straps 12' to be affixed to the eyes 15'. Although the paper towels 10'' are too flimsy for reuse, the speed with which the skimmer may be deployed, and the brevity and simplicity it brings to the clean-up process at the end may justify the added expense of the paper. Cleanup would consist of merely peeling it off the tube, rolling it up, letting the water drain out, and discarding the paper.

THEORY OF OPERATION

In practice, working with two persons, the skimming apparatus 13 is stretched out as close as possible along the deep end wall of the pool so as to form a continuous floating barrier across that end of the pool, and in such a manner as to force any foreign matter clinging to or floating in the area of that wall, ahead of the skimming apparatus 13 toward the shallow end of the pool. Then, with each person pulling an end along as close as possible to a respective side wall, the skimming apparatus 13 sweeps the pool from the deep end toward the shallow end so that all of the matter floating on the water surface will be forced ahead of the skimmer apparatus 13 toward the shallow end of the pool. If there are ladders or railings or other obstructions to contend with along the path, the appropriate end of the skimmer apparatus 13 may be manipulated behind and about the obstruction(s) so as to force any debris ahead of the skimmer apparatus 13.

Figure 6:
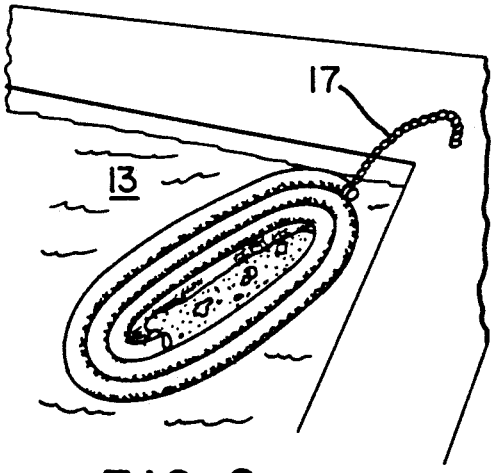
FIG. 6 is a perspective view of the swimming pool skimming apparatus in a coiled position.

When the shallow end of the pool is reached, then each person pulls his end close along the end wall toward the center until the ends of the skimming apparatus 13 meet and overlap as shown in FIG. 6, so as to form a circular loop with all of the debris corralled in its center. Most of this debris will be floating on the surface of this inner pool, but much of it will be clinging to the soft fibers and loose weave of the a fabric 10' along the inner face of the skimmer apparatus 13.

If this operation is to be undertaken by one person, then he or she could proceed as follows: affix the line 16 or straps 12 at each end of the skimmer apparatus 13 to the portable weight 17, and then, having arrayed the skimmer apparatus 13 along the deep end wall (as described above for two persons), using the weight 17 to hold the untended skimmer end(s) in the desired temporary positions, proceed to move one side of the skimmer apparatus 13 five or ten feet along the side wall, anchor it there temporarily, and then, move to the other side (which can then be moved twice as far), and thus by increments, move the entire skimming apparatus 13 to the shallow end and thus accomplish the same task as it would be done by two persons in very little more time.

After the skimmer apparatus is formed into a loop as shown in FIG. 6, it is generally more expedient for one person to enter the pool outside the loop, and by grasping both ends of the skimmer apparatus 13, proceed to wind one end inside the other as though flemishing a line or winding a spring, until the inner circle has been reduced to a diameter of two or three feet, thereby concentrating the density of the debris. Depending on the nature and amount of this debris it may be preferable to scoop most of it out onto the pool deck, (using any convenient watertight utensil with a wide lip). After the debris is removed from the pool, it is a simple matter to place one's arms under the entire skimming apparatus 13, as though grasping an armload of firewood, and with one continuing motion, lift and thrust it all out onto the pool deck. If preferred, this can be done from pool side without entering the pool. The apparatus can be brought into the coiled formation by using a pool rake or brush in one hand to manipulate and wind the inner end of the apparatus while holding the outer end fixed with the other; and then when coiled, drawn tight to the pool wall, and removed by placing one arm outside, around and under the entire apparatus and wrenching it out onto the pool deck. It can then be hosed off in place or taken to a laundry tub and rinsed out.

For those pool decks which do not possess adequate drainage or have a hose conveniently located, it would be easier to slip the sleeve of fabric 10 of the first embodiment off the flotation tube 11, rinse the heavy debris off in the wash tub and/or put it in the washing machine, dry it in the dryer, and then thread it back on the tube.

The second embodiment would be more more expedient to use if it is not convenient to hose off the skimmer 13 on the deck and less cumbersome than removing and rethreading sleeve 10. When conducting the skimming operation using the second embodiment, the flemishing of the apparatus into the form of a coil, and the removal of the apparatus to the pool deck—with the entrapped debris and scum—are effected as outlined for the first embodiment. However, once the skimmer apparatus 13 is uncoiled and stretched out on the pool deck, it is a simple matter to free the ends and peel off the befouled length(s) of any of these materials, put them in a bucket or other container, and carry them off to the laundry where they can be rinsed out in the set-tub and/or included with the regular, machine washable laundry, or if disposable, discarded in the trash. The unblemished flotation tube can be returned to its storage place without any further action. Although a little more effort is required in laying out the length(s) of fabric or disposable material at the beginning of the operation, this effort is greatly rewarded through the effortless simplicity of the clean-up process gained at the end.

An additional benefit is gained when employing any of the above improvements in that by having the fabric 10' or absorbing material hang straight down from the leading and following edges of the flotation tube 11, a totally vertical barrier is formed that extends from about one inch above, to about seven inches below the surface of the water; whereas the sleeve of fabric 10 tapers ahead or back toward its underwater center. The arrayal of fabric 10' so that it hangs vertically from the tube improves the ability of the apparatus to engage and corral the scum and debris during the flemishing process. More importantly however, it greatly enhances the ability of the apparatus to perform the final critical step: that of removing the apparatus from the swimming pool's surface to the pool deck without losing any of the entrapped debris or scum through its underside.

The procedure to accomplish this step remains unchanged, with the coiled apparatus floating between one's body and the pool's end wall, pressure is applied to the outer limbs of the coil so as to squeeze the inner pool closed and force the entrapped scum and debris into the folds of the absorbing fabric 10', and then engulfing the apparatus 13 underwater like an armload of firewood, while simultaneously sealing off any route of escape by holding the underwater folds of material closed, the entire apparatus is thrust up and out of the water onto the pool deck. With the fabric 10' hanging vertically as described above none of the material or debris is lost as was possible with the tapered fabric 10. With the absorbing fabric 10' thus arrayed, its entire leading, underwater area is completely engaged at all times at the foremost point of attack, and the folds of fabric 10' hanging vertical, parallel and adjacent within the flattened coil are naturally better disposed to more effectively seal the underside closed than is the case when they taper away from each other.

While the invention has been explained with respect to a preferred embodiment thereof, it is contemplated that various changes may be made in the invention without departing from the spirit and scope thereof.

What is claimed is:

1. A swimming pool water skimming apparatus for removing large objects as well as corralling and removing the finer debris and scum comprising:

buoyant tubular means having a first and a second end, said tubular means consisting of a plastic or rubber tube sealed at said first and second ends and said first end having valve means for inflating said tubular means, fibrous absorbent material means covering the entire length of said tubular means, and suspended from said tubular means within said water, fastening means located at said first and second ends, said fastening means comprising straps for cinching said fibrous absorbent material to said tubular means, and operating means affixed to said fastening means for operating or controlling said skimming apparatus.

2. A skimming apparatus as set forth in claim 1, wherein said fibrous absorbent material means comprises a sleeve consisting of a soft, loosely woven fabric.

3. A skimming apparatus as set forth in claim 1, wherein said fibrous absorbent material means consists of at least one length of a soft, loosely woven fabric covering the entire length of said buoyant means, said fabric hanging vertically in said water, said fabric having eyelets located at opposite ends thereof and being affixed to said buoyant means with said fastening means led through said eyelets.

4. A skimming apparatus as set forth in claim 1, wherein said fastening means comprises a self-gripping fastening system consisting of a loop tape and a hook tape which when fastened together, holds tight against a direct pull and peels apart when desired.

5. A swimming pool water skimming apparatus for removing large objects as well as corralling and removing the finer debris and scum comprising:

a vinyl or rubber tube sealed at a first and a second end, said first end having a valve mounted therein for inflating said tube to form a firm mounting base, a fibrous absorbent material covering the entire length of said tube and hanging vertically in said water, on opposite sides of said tube, said material having grommets located therein at opposite ends thereof, fastening means led through said grommets and affixed to said tube for holding said material on said tube at said first and second ends, and operating means affixed to said fastening means for operating or controlling said skimming apparatus.

6. A skimming apparatus as set forth in claim 5, wherein said fibrous absorbent material is seamed at said opposite ends to form hoods to hold said material in position.

7. A skimming apparatus as set forth in claim 5, wherein said fibrous absorbent material consists of paper towels.

* * * * *